US005575128A

United States Patent [19]

Haener

[11] Patent Number: 5,575,128

[45] Date of Patent: Nov. 19, 1996

[54] INTERLOCKING MORTARLESS BUILDING BLOCK SYSTEM

[76] Inventor: Juan Haener, 8215 Harton Pl., San Diego, Calif. 92123

[21] Appl. No.: 265,804

[22] Filed: Jun. 27, 1994

[51] Int. Cl.[6] ..... E04C 1/00

[52] U.S. Cl. ..... 52/572; 52/604; 52/606; 52/504; 52/286; 52/100; 52/592.6

[58] Field of Search ..... 52/284, 286, 561, 52/562, 569–572, 589.1, 603–606, 592.6, 504, 100

[56] References Cited

U.S. PATENT DOCUMENTS

| | | | |
|---|---|---|---|
| 708,499 | 9/1902 | Searight et al. | 52/603 X |
| 868,838 | 10/1907 | Brewington | 52/604 X |
| 3,888,060 | 6/1975 | Haener | 52/284 |
| 4,107,894 | 8/1978 | Mullins | 52/606 X |
| 4,182,089 | 1/1980 | Cook | 52/562 X |
| 4,426,815 | 1/1984 | Brown | 52/605 X |
| 4,473,985 | 10/1984 | Hunt | 52/570 X |
| 4,475,326 | 10/1984 | Hanson | 52/286 |
| 4,640,071 | 2/1987 | Haener | 52/286 |
| 4,854,103 | 8/1989 | Klym | 52/286 X |
| 4,896,472 | 1/1990 | Hunt | 52/592.6 |

*Primary Examiner*—Robert J. Canfield
*Attorney, Agent, or Firm*—John R. Duncan; Frank D. Gilliam

[57] ABSTRACT

An interlocking lock system for mortarless wall or other structure assembly in which a plurality of blocks are laid up in courses in a staggered relationship. Only two different block configurations are required, the first, or long, blocks having a length at least twice the block height and the second, or short, blocks having a length up to half the length of the first blocks. Each of the blocks has a pair of upright sidewalls having flat top and bottom surfaces and generally parallel outermost side surfaces and has at least two spaced transverse walls. Protrusions on the inner surfaces of the sidewalls extend from a base generally coplanar with the block bottom surface to a tip extending above the block top surface and configured so that the tips and bases interlock when the blocks are laid up in staggered courses. Further interlock arrangements are provided so that the long blocks will interlock when positioned either parallel along walls or perpendicular at corners. A tongue and groove interlock configuration is provided at the ends of the blocks so that the ends interlock.

14 Claims, 4 Drawing Sheets

INTERLOCKING MORTARLESS BUILDING BLOCK SYSTEM

BACKGROUND OF THE INVENTION

This invention relates in general to blocks for use in construction of walls, buildings and the like and, more specifically, to a mortarless building block system generally requiring only two different block configurations.

Conventional concrete block construction uses rectangular blocks, generally having one or more cavities through the blocks from top to bottom. A layer of mortar is thrilled onto a foundation and a course of closely spaced blocks are laid on the layer, with additional mortar applied between the contiguous block ends. Another layer of mortar is applied to the top of the first course and additional courses are similarly laid, generally staggering the block ends from course to course. Great care and skill is required to achieve level courses and a truly vertical wall. Because of the time and skill required for such construction, costs are high.

Various types of interlocking blocks have been devised in the past to facilitate the construction of block walls and other structures. Most such blocks have been very expensive to produce since the interlocking portions, usually grooves or protrusions, are normally cut into the blocks after they have been formed by molding. Further, it is difficult to maintain the required tight tolerances required for accurate construction of large walls or other structures through the molding and cutting steps. The prior blocks often required additional finishing or grinding steps to meet the require tolerances.

Excellent interlocking mortarless building blocks overcoming many of these deficiencies are describe in U.S. Pat. No. 3,888,060, and 4,640,071, both granted to the inventor of the present invention. Those blocks have been used successfully for many years. These blocks are assembled in courses, with the block joints staggered and continuous vertical open cells into which reinforcing bars ("rear") and wet concrete can be inserted. While highly effective, these blocks require that rebar be inserted in lower courses, with blocks in later courses lifted over the ends of the rebar as the structure advances and wet concrete is periodically poured into the cells containing the rebar. Thus installing blocks over rebar can be a significant problem with tall structures.

Also, three or more different block configurations may be required for many structures, such as walls, buildings with openings and floor panels connected to the block wall. Additional block configurations require the manufacture of additional expensive molds and increased cost and time in changing molds in a block making machine and maintaining and inventory of the different block configurations.

Therefore, there is a continuing need for improvements in these successful mortarless block systems to permit lower cost block manufacture and lower cost and more rapid structure assembly from the blocks. Additional benefits will derive from more attractive blocks, especially at structure corners, and the ability to incorporate different block face and/or structure designs, interconnected floor panels, etc while minimizing the number of different block configurations.

SUMMARY OF THE INVENTION

The above noted problems are overcome, and advantages achieved, by a block system which includes two basic block configurations including a first elongated block, typically having a length at least twice the block height, and a second, short block, typically no more than half the length of the long block, for filling in at wall ends and openings, etc., where long blocks are laid in staggered courses.

Each of said first, long, blocks has a pair of spaced, upright sidewalls each having flat top and bottom surfaces and generally parallel outermost side surfaces. The block face surfaces may have various decorative designs, as desired. Block end interlock means, typically cooperating vertically oriented tongue-and-groove arrangements, are provided at the ends of the sidewalls. A first transverse wall extends between the sidewalls at a first end of the block. A second transverse wall extends between the sidewalls at a selected location spaced from the second end of the block. If desired, additional transverse walls could be provided for added strength in locations that do not interfere with the interlocking means.

At least three protrusions along the inner side of the sidewalls, each having a base generally coplanar with the bottom surface of the sidewall and a tip extending above the upper surface of the block, are provided. The first and second protrusions are located adjacent to the second end of the block (which may also form part of the second transverse wall) and a third protrusion is located adjacent to the first end wall. The tips of the protrusions extending above the top surfaces of the sidewalls are sized and located to interlock with the next higher course which is laid in a staggered relationship to the lower course.

Between-course interlock means are provided on the sidewall opposite the third protrusion and on the first transverse end wall to interlock with a second (short) block in the next higher course, with the short block is laid parallel to the other blocks in that course.

The second, short, blocks have sidewalls generally similar to the long block sidewalls and two transverse end walls. Two protrusions are provided on the interior of the sidewalls, extending from a base generally coplanar with the bottom surface to a tip extending above the upper surface of the sidewalls. The upwardly extending tips interlock with the between-course interlock means on the long blocks. The short blocks may also be laid up to form a column, with each succeeding short block oriented 180° to the next lower and next higher block.

When the embodiment of the long block described above is used in building a wall in which long rebar extends up from a foundation, each block at the rebar location is lifted over the rebar and lowered into position with the rebar extending up through the opening bounded by sidewalls and transverse walls. Then wet concrete is poured into the opening to bond to the blocks and rebar.

If desired the second transverse wall may be substantially aligned with the two opposite protrusions or may be spaced further from the second end than those protrusions, in effect leaving a deep open end, preferably at least ¼ of the block length.

In the block embodiment having the second transverse wall at least ¼ of the block length from the open end are used to build a wall on a foundation having vertically extending long rebar secured in the foundation, the blocks may be placed with the rebar opening between the second transverse wall and the second, open, block end, so that blocks can be placed from either side of the rebar to form a vertical opening without having to lift blocks over the rebar.

In some structures, such as walls or building enclosures, it is desired to have concrete floor panels extend horizontally from the block wall at selected heights. The floor panels should extend into the wall about half the wall width and be supported by the wall. With prior blocks, attempts to split blocks vertical along their longitudinal centerline to form shell blocks and place them next to the floor panel prior to laying the next course above the floor panel was often unsuccessful, since nothing held the shell blocks in place and they tended to fall away. With the blocks described above, the blocks can be cut along the longitudinal vertical centerline forming two shell blocks each of which can and placed next to the floor panel and be held in place by the interlocking protrusions described above while the next course is laid. If desired, shell blocks may also be produced by placing a longitudinal separator in the mold prior to block formation so that two shell blocks result.

In some cases, horizontal rebar extending through some block courses is required by building codes. The blocks of this invention may be easily molded with notches in the upper edges of the first transverse end wall and the second transverse wall to allow the horizontal rebar to be installed and held in place by wet concrete placed in the cavities within the blocks. Or, notches extending slightly down an end wall may be provided so that the upper edge of the end wall may be broken away to provide room for horizontal rebar.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 3:
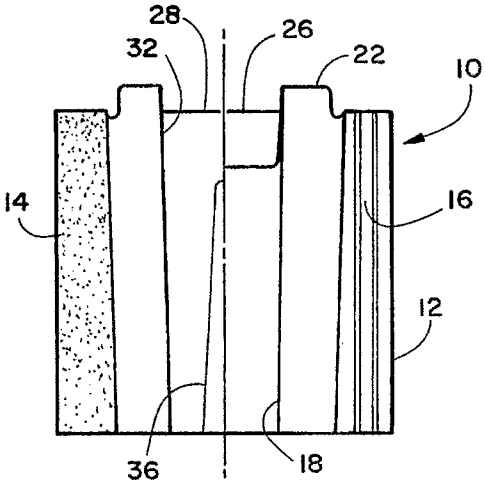
FIG. 3 is a section view taken on line 3—3 in FIG. 1.
Figure 1:
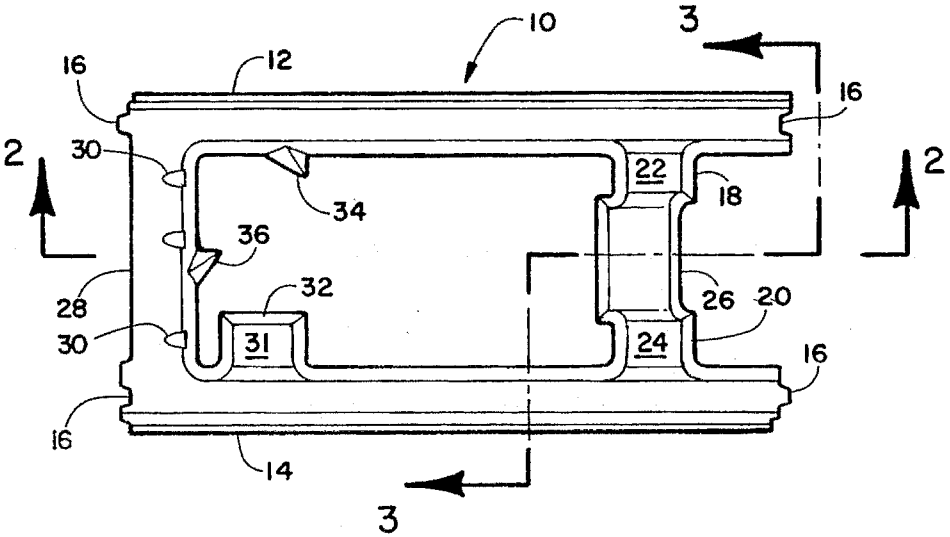
FIG. 1 is a plan view of a first, long, block of this invention.
Figure 2:
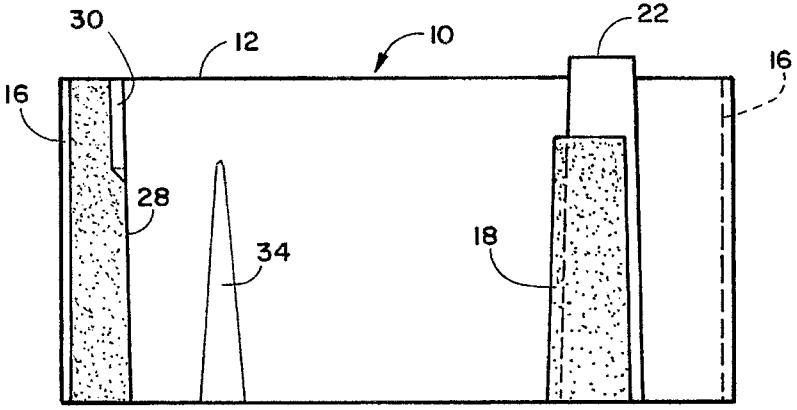
FIG. 2 is a section view taken on line 2—2 in FIG. 1.

Referring to FIGS. 1–3, there is seen an elongated first block 10 having a pair of spaced, upright sidewalls (face shells) 12 and 14. Sidewalls 12 and 14 have generally parallel outer surfaces, although a slight taper from narrow at the top to wider at the bottom is desirable for ease of removal from the mold in which the block is formed. If desired, a greater taper could be used to provide shadow lines at the course interfaces. Any suitable finish, color and texture may be used. Sidewalls 12 and 14 have flat top and bottom surfaces. For ease of removal, eliminating the need for complex molds, the block should have no undercuts.

Block interlock means 16 are provided at each end of each sidewall to lock adjacent blocks together. Preferably, the block interlock comprises a vertical tongue and groove arrangement as shown.

First and second opposed protrusions 18 and 20 are provided near a first end of block 10. Protrusions 18 and 20 lie along the inner surfaces of sidewalls 12 and 14, extending from a base that is substantially coplanar with the bottom surface of the block to tips 22 and 24 extending just above the top surface. When staggered courses of these blocks are assembled, the protruding extended tips 22 and 24 extend into the upper course, engaging the bases of the upper block protrusions to hold the blocks in place (this interlocking being best seen in FIGS. 6–9). Protrusions 18 and 20 are tapered, narrowing from bottom to top to allow easy removal from the mold and to position the top and bottom ends for proper interlock for the selected overall block dimensions.

A first transverse wall 26 extends between sidewalls 12 and 14 near the first end of block 10. In the embodiment shown in FIGS. 1–3, transverse wall 26 extends between protrusions 22 and 24. Preferably, transverse wall 26 is lower than the sidewall, to provide room to run horizontal rebar therethrough, if desired.

A second transverse web 28 extends between sidewalls 12 and 14 at the second end of block 10. If desired, a plurality of notches 30 may be provided in transverse webb 28 to aid in breaking away an upper portion of that wall to permit rebar or the like to extend horizontally through the block. Alternatively, the top edge of webb 28 could be molded at a lower height to permit passage of rebar or the like. The lower portion of the top edge of webb 28 may be formed by breaking away portions of the top wall or by molding webb 28 with one or more depressions therein.

A third protrusion 32, which is provided along one sidewall adjacent to the second transverse webb 28, is generally similar to first and second protrusions 18 and 20 and is positioned to interlock with protrusions on staggered blocks in the next succeeding course, as discussed above.

Figure 7:
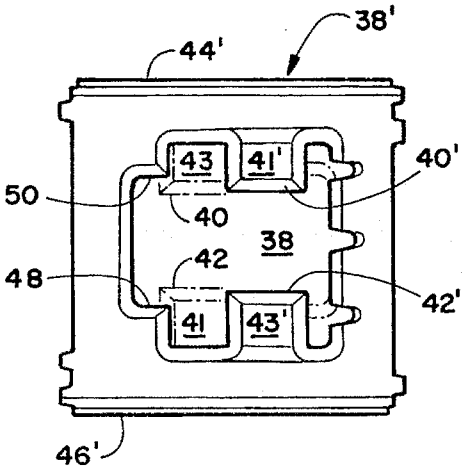
FIG. 7 is a plan view showing a column formed by two overlapping short blocks arranged at 90° to each other.
Figure 6:
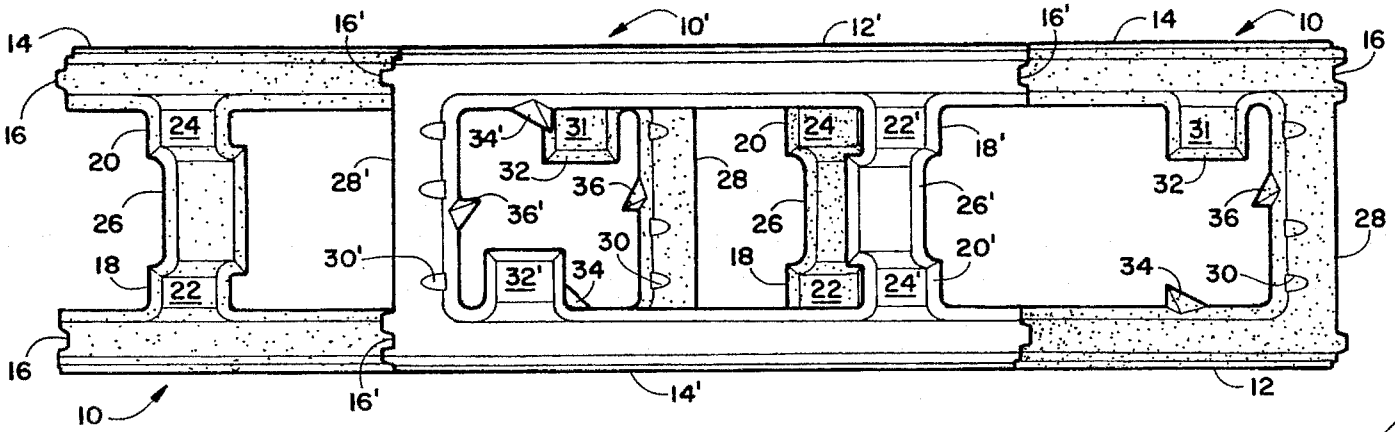
FIG. 6 is a plan view showing the interlocks in a wall formed by one long block overlapping two long blocks.
Figure 8:
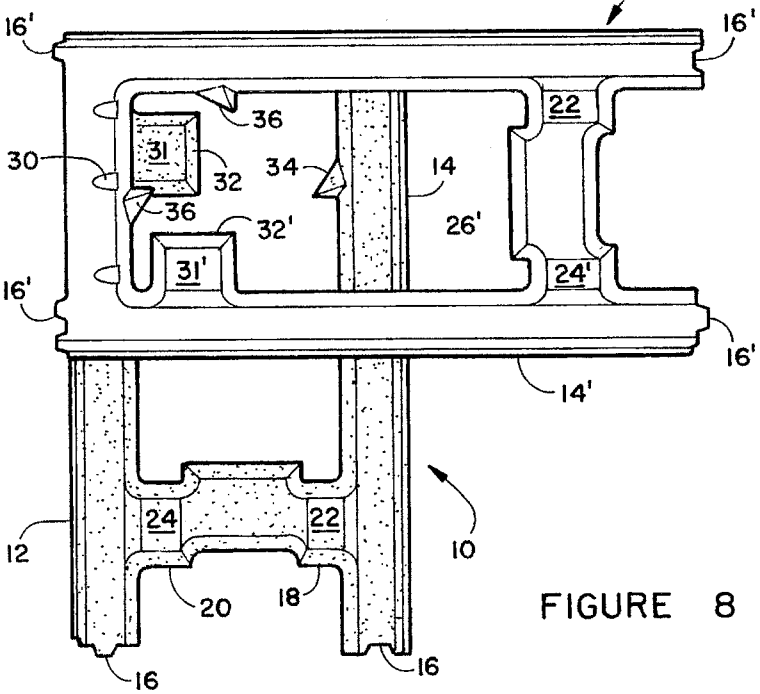
FIG. 8 is a plan view showing the interlocks at a corner formed by two overlapping long blocks.

First and second tapered between-course interlock means 34 and 36 are provided on the interior of sidewall 12 and second transverse end webb 28. Each has approximately a right triangular cross section, which could be curved and approximate a right triangular cross section so long as the one surface is substantially perpendicular to the sidewall surface, as shown. Alternatively, the face of interlock means 34 could lie at an angle greater than 90° to the wall where the corresponding tip has a substantially identical angle. Interlock means 34 tapers from the bottom surface of the block to an intermediate height. These means are configured and positioned to cooperate with tips of protrusions on the next lower course, as illustrated in FIGS. 6–8 and described below. In certain cases, such as lintels over a window or other opening, short blocks could be oriented perpendicular to long blocks in the next course, if desired.

Figure 4:
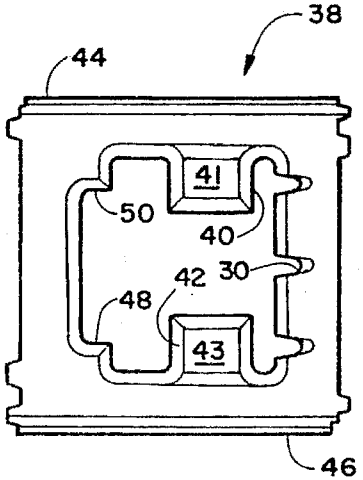
FIG. 4 is a plan view of a second, short, block according to this invention.

FIG. 4 shows short block 38 in plan view. Except for the lesser length, short block 38 is generally configured as is long block 10, with vertical surfaces tapered to allow easy removal from the mold. Tongue-and-groove-interlocks 16 match those on long block 10. End walls may have notches 30 to permit portions of the upper end walls to be broken away to permit access for running horizontal rebar or the like.

Protrusions 40 and 42, generally similar to protrusions 22, 24 and 32 on long block 10, are arranged on the interior of sidewalls 44 and 46, respectively. Protrusions 40 and 42 have tips 41 and 43, respectively, extending above the upper surface of the block 38. Inwardly directed corners 50 and 48 are preferably provided to aid in interlocking with protrusion tips on the next lower course of blocks. The space between corner 50 and protrusion 40 and between corner 48 and protrusion 42 is sized to fit the tip 31 of the protrusion 32 in the next lower course of long blocks 10 at a wall end or at an opening.

In a structure having a corner between two walls formed of the long blocks, the tongue and groove means 16 at the exposed end of an end block will be exposed, adding a decorative feature, alternating between surfaces in alternate courses. At the end of a wall, short blocks 38 will be the last block in every other course. In order to form the same decorative feature between succeeding courses, short blocks may be oriented parallel to the long blocks, with all exposed tongue and grooves patterns at the end of the wall.

Figure 5:
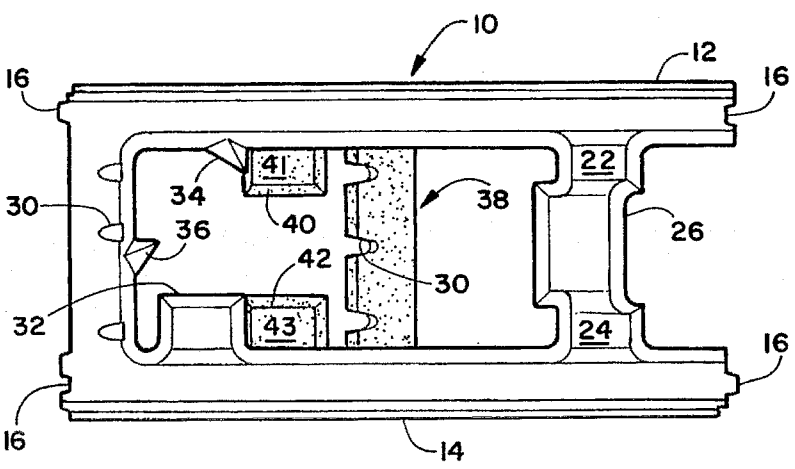
FIG. 5 is plan view of a long block placed over and aligned with a short block arranged parallel to the long block to form the end of a wall.
Figure 9:
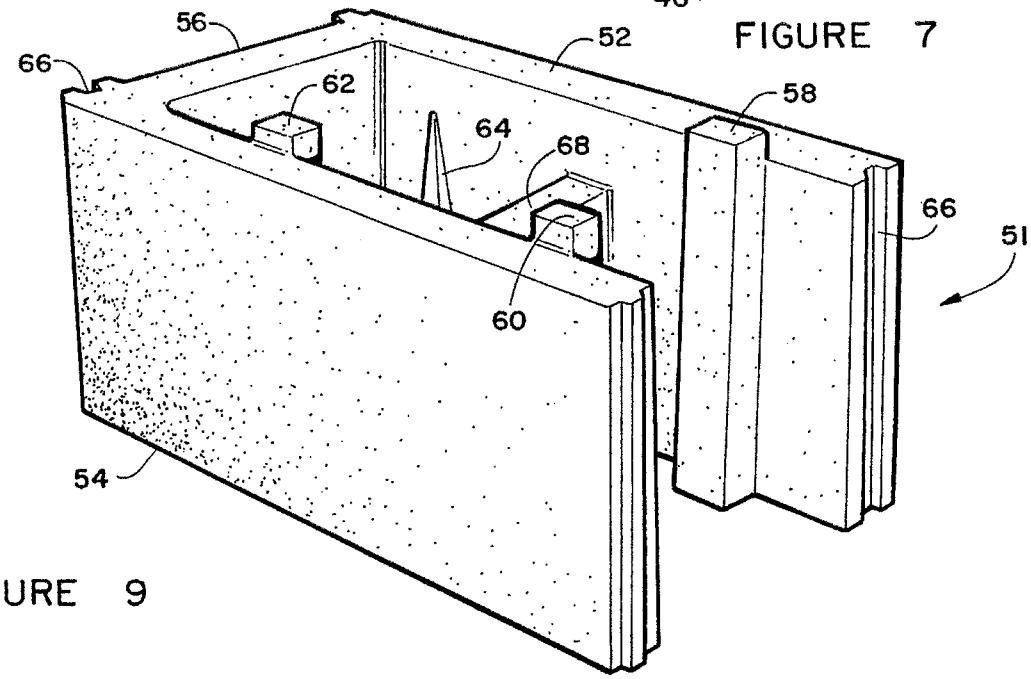
FIG. 9 is a perspective view of an embodiment of the long block having an extended open end.

FIG. 5 is a detail plan view, showing a long block 10' above a short block 38, with the two blocks arranged parallel. For clarity of illustration, references of block components for the upper course will be identified as a prime, i.e., the upper block is block 10' while the lower block is block 38.

Tongues and grooves 16 on both blocks will be exposed at the end of the assembly. The upstanding tip 43 of short block protrusion 42 will extend upwardly into the lower surface of long block 10, abutting the base of long block protrusion 32'. The upstanding tip 41 of short block protrusion 40 will extend upwardly into the lower surface of long block 10, abutting the side of interlock means 34'. Similarly, though not shown, the upstanding tip 31 of long block protrusion 32' will extend upwardly into the lower surface of the next short block 38 above long block 12 when that short block is laid in place, abutting the base of short block protrusion 42 and corner 48, as seen in FIG. 4. Thus, these blocks will be firmly held in position.

FIG. 6 shows a small portion of a wall with one block 10' overlapping two blocks 10 in the next lower course. Again, for clarity of illustration, references of block components for the upper course will be identified as a prime, i.e., the upper block is block 10' while the two lower blocks are blocks 10.

Blocks 10 are abutting, with tongue-and-groove means 16 (not seen) interlocking. Tip 31 of left block 10 extends into the lower surface of block 10' and engages interlock means 34'. Tips 22 and 24 of right lower block 10 also extend into the lower surface of block 10'. Tip 22 engages the base of protrusion 24' and tip 24 engages the base of protrusion 22'. Thus, the combination of these interlocks serve to prevent movement of left and right blocks 10 away from each other in any horizontal direction.

Columns can be formed from short blocks 38 simply by rotating each succeeding block 180°. The interlocking of such blocks is shown in FIG. 7. As before, components of the upper block are identified with a prime.

Tip 41 of lower block 38 extends upwardly into the lower plane of block 38', engaging corner 48 and the base of protrusion 42'. Tip 43 extends upwardly into engagement with corner 50 and the base of protrusion 41'. Thus, relative movement between the blocks in a horizontal plane is prevented.

FIG. 8 shows a portion of a corner formed by one long block 10' overlapping a block 10 with the two blocks lying perpendicular to each other. The upwardly extending tip 22 of protrusion 18 of the lower long block 10 will interlock with interlock means 36'. If lower block 10 were reversed (rotated in a horizontal plane) tip 31 of protrusion 32 would extend up into block 10' and engage interlock means 36'.

while in general long blocks having lengths equal to twice their widths (e.g., the standard 8 by 16 inch blocks) with short blocks having equal widths and lengths (e.g., 8 by 8 inch blocks) are preferred, other dimensions may be used, if desired, so long as the long blocks have lengths at least twice their width and the short blocks are up to half the length of the long blocks. For example, a combination of 8 by 24 inch long blocks and 8 by 8 inch short blocks would be suitable.

With the blocks shown in FIGS. 1–6, if the blocks are to be assembled on a foundation with rebar extending upwardly from the foundation, it is necessary to lift the blocks over the top of the rebar, so that the rebar extends upwardly through the overlapping cavities in each course of blocks. Where the rebar is very long, the alternative embodiment of long blocks 51 shown in FIGS. 9 and 10 may be preferred.

Long block 51 has sidewalls 52 and 54, end wall 56 and three protrusions 58, 60 and 62, interlock means 64 and tongue and groove interconnect means 66, generally similar to the corresponding features in block 10 described above. In this embodiment, however, second transverse wall 68 does not extend between protrusions 58 and 60; rather, it is positioned further from the open block end. The edge of wall 68 closest to the open block end should be a distance from the open block end equal to at least about ¼ of the block length where the block width to length ratio is about 1:2. With blocks that are longer relative to the width, or the course-to-course overlap is not one half of the blocks in succeeding courses, transverse wall 68 is spaced from the open end a sufficient distance to provide the necessary open vertical channel through the wall to accommodate rebar 70 as seen in FIG. 10.

Figure 10:
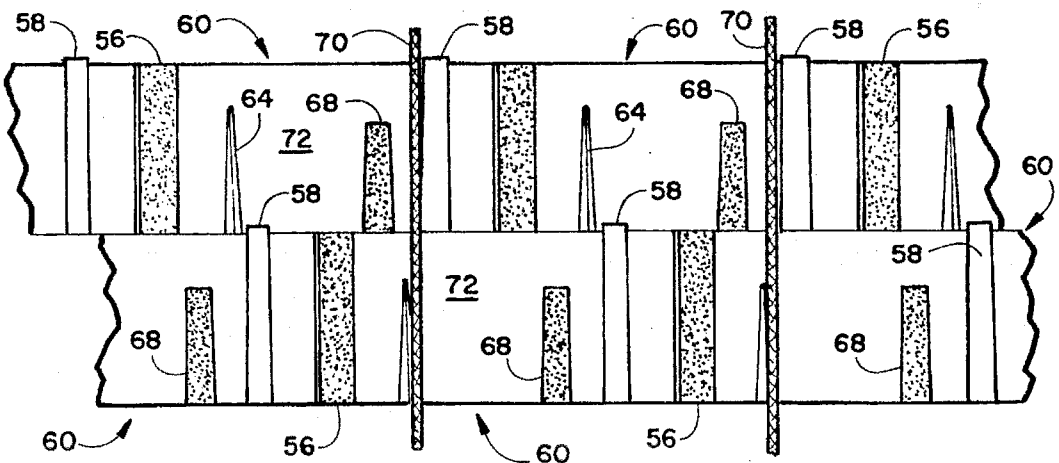
FIG. 10 is a vertical section through a wall constructed of the blocks of the embodiment shown in FIG. 9.

As seen in FIG. 10, a longitudinal section through approximately the center of a wall made up of blocks 61. The blocks in succeeding courses can be moved horizontally into position with the open ends of the blocks surrounding rebar 70. In the embodiment shown in FIG. 10, the ends of the blocks in each course fall half way along the blocks in the adjacent courses. As can be seen, with the side of each transverse wall 68 about one quarter of the block length from the block open end, there is just sufficient space for rebar 70 to run vertically through the assembled blocks. Greater rebar space could be provided by positioning the side of transverse wall 68 slightly further from the open end of the block. The cavities in the blocks 61 through which the rebar 70 runs can be filled with wet concrete 72 for the desired strengthening.

Figure 11:
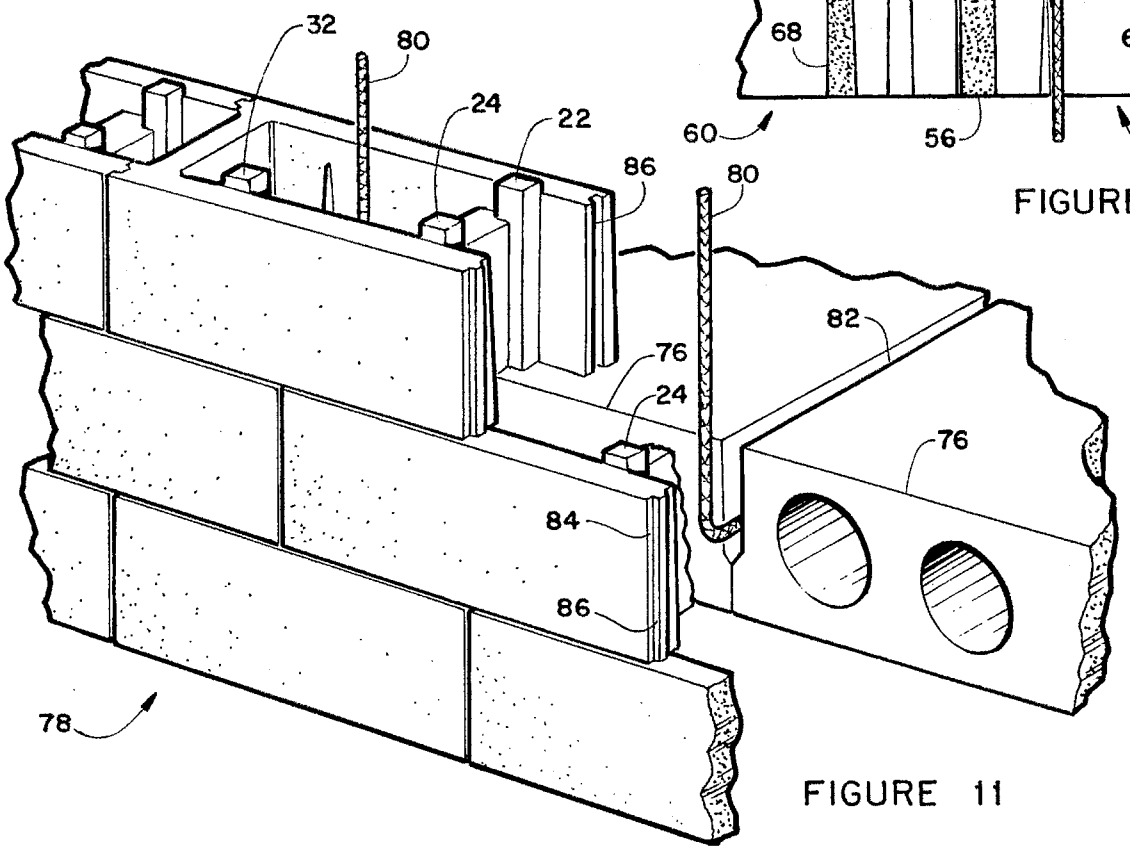
FIG. 11 is a perspective view of a wall having a connected floor panel.

FIG. 11 illustrates how effectively the mortarless interlocking block assembly of this invention can accommodate the need to support floor panels 76 at selected heights along the wall.

The wall 78 is assembled using blocks 10, 38 and/or 61, as desired, to the height at which the floor 76 is to be installed. Floor panels are emplaced (or cast in place) with the floor panel edges extending approximately half way over the wall blocks. Rebar 80 may be installed in grooves 82 in floor panels and bent to extend up within the succeeding block courses. Long blocks 10 or 61 (whichever is being used) are cut along a longitudinal vertical centerline. A course of the resulting half-blocks 84 is laid adjacent to floor panels 76. Where practical, the floor panels 76 can be post tensioned prior to installation of single shell blocks 84, since this system allows room for the post tensioning tools after panels 76 are placed on the lower course of full blocks.

A course of blocks is then laid, with the protrusions 24 and 32 (not seen) of single shell blocks 84 interlocking with the next succeeding course, holding the single shell blocks firmly in place. The single shell blocks are also held in place by the tongue and grooves 86 at the ends of the sidewalls.

Thus, assembly of the wall can rapidly proceed without any particular precautions to hold the single shell blocks in place during assembly, as would be necessary with prior such half-blocks, While certain preferred materials, dimensions and arrangements have been described in detail in conjunction with the above description of preferred embodiments, those can be varied, where suitable, with similar results. Other applications, variations and ramifications of this invention will occur to those skilled in the art upon reading this disclosure. Those are intended to be included within the scope of this invention as defined in the appended claims.

I claim:

1. An interlocking block system for mortarless wall assembly in which a plurality of blocks are laid up in courses in a staggered relationship wherein two different block configurations are provided, the first blocks having lengths at least twice the width and the second blocks having the same width and a length up to half the length of said first blocks, which comprises:

a plurality of said first blocks, each of which comprises:

a pair of spaced, upright sidewalls having substantially flat top and bottom surfaces and generally parallel outermost side surfaces;

said sidewalls having lengths at least twice their height;

block end interlock means at the opposite ends of said sidewalls;

one first transverse end wall extending between said sidewalls at a first end of said first block;

at least one second transverse wall extending between said sidewalls spaced from a second end of said first block;

two opposed first and second protrusions on interior surfaces of said block adjacent to said first end of said first block said first and second protrusions each having an approximately right triangular cross section and a base substantially coplanar with said substantially flat sidewall bottom surfaces, one said protrusion extending upwardly along each of a sidewall and said first transverse end wall and tapering to a smaller cross section and ending short of the top surfaces of said sidewalls and first transverse end wall;

one third protrusion on an interior surface of one of said sidewalls adjacent to said first end of said block, said third protrusion extending along a sidewall from a base to a tip extending above said top surface to interlock with a block in the next succeeding course;

between-course interlock means within said second transverse wall for interlocking with a second block in the next course laid parallel to one said first block;

a plurality of said second blocks, each of which comprises:

a pair of spaced, upright sidewalls having substantially flat top and bottom surfaces and generally parallel outermost side surfaces;

said sidewalls having lengths up to about half the lengths of said first block sidewalls;

block end interlock means at the opposite ends of said sidewalls;

transverse end walls extending between said sidewalls of said second block; and fourth and fifth protrusions along the interior of said sidewalls each extending from a base generally coplanar with the bottom surface to a tip extending above said sidewalls for interlocking with said between-course interlock means in a next course of blocks laid either parallel or perpendicular to one said second block;

whereby block walls, enclosures and columns may be built using only said first and second blocks.

2. The interlocking block system according to claim 1 wherein each block end interlock means comprises tongue and groove means.

3. The interlocking block system according to claim 1 wherein said second transverse wall has a height less than the height of said sidewalls.

4. The interlocking block system according to claim 1 wherein said second transverse wall extends at least partially between said two protrusions inside of said sidewalls adjacent to said second end of each block.

5. The interlocking block system according to claim 1 wherein said second transverse wall extends between said sidewalls at a location between said two protrusions and said first end of said first block.

6. The interlocking block system according to claim 1 further including a plurality of notches in a surface of at least one transverse end wall.

7. The interlocking block system according to claim 1 wherein at least a portion of a top edge of at least one transverse end wall has a height less than the height of said sidewalls.

8. An interlocking block system for mortarless wall assembly in which a plurality of blocks are laid up in courses in a staggered relationship wherein two different block configurations are provided, the first blocks having a length at least twice the width and the second blocks having the same width and a length up to half the length of said first blocks, wherein each said first block comprises:

a pair of spaced, upright sidewalls having flat top and bottom surfaces and generally parallel outermost side surfaces;

said sidewalls having lengths at least twice their height;

block end interlock means at opposite ends of said sidewalls;

one first transverse end wall extending between said sidewalls at about a first end of said first block;

at least one second transverse wall extendin between said sidewalls spaced from a second end of said first block;

two protrusions, one inside of one of each said sidewalls adjacent to said second end of said first block and one protrusion inside one said sidewall, adjacent to said first end of said first block, all extending from a base substantially coplanar with said sidewall bottom surfaces and having tips extending above said sidewall top surfaces configured to interlock with a block in a next succeeding course;

between-course interlock means along the sidewall opposite said one protrusion and along the interior surface of said first transverse end wall for interlocking with a first or second block in the next course laid either parallel or perpendicular to said first block; and said between-course interlock means comprising elongated protrusions having a generally right triangular cross section coplanar with said flat sidewall bottom surfaces, one said protrusion extending upwardly along each of a sidewall and said first transverse end wall, tapering to a smaller cross section and ending short of the top surfaces of said sidewall and first transverse end wall.

9. The interlocking block system according to claim 8 wherein each said first block end interlock means comprises tongue and groove means at the ends of said sidewalls.

10. The interlocking block system according to claim 8 wherein said second transverse wall has a height less than the height of said sidewalls.

11. The interlocking block system according to claim 8 wherein said second transverse wall extends between said two protrusions.

12. The interlocking block system according to claim 8 wherein said second transverse wall extends between said sidewalls is at a location between said two protrusions and said first end of said first block.

13. The interlocking block system according to claim 8 further including a plurality of notches in an interior surface of said first transverse end wall.

14. The interlocking block system according to claim 8 wherein at least a portion of a top edge of said first transverse end wall has a height lower than said sidewalls.

* * * * *